US007597751B2

(12) United States Patent
Chang et al.

(10) Patent No.: US 7,597,751 B2
(45) Date of Patent: Oct. 6, 2009

(54) CARRIER GAS RECYCLING SYSTEM

(75) Inventors: Chih-Chiang Chang, Hsinchu (TW); Cha-Yu Chang, Hsinchu (TW); Ji-Chern Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 433 days.

(21) Appl. No.: 11/417,115

(22) Filed: May 4, 2006

(65) Prior Publication Data

US 2007/0134137 A1 Jun. 14, 2007

(30) Foreign Application Priority Data

Dec. 9, 2005 (TW) ..... 94221416 U

(51) Int. Cl.
*F27B 15/00* (2006.01)

(52) U.S. Cl. ..... 96/417; 422/139; 422/187

(58) Field of Classification Search ..... 96/417; 422/139, 140, 141, 142, 143, 144, 145, 146, 422/147, 187

See application file for complete search history.

(56) References Cited

U.S. PATENT DOCUMENTS 4,983,278 A * 1/1991 Cha et al. ..... 208/407
5,325,797 A * 7/1994 Mei et al. ..... 110/245
5,502,872 A * 4/1996 Chae et al. ..... 15/320
5,728,271 A 3/1998 Piskorz et al.
5,880,480 A * 3/1999 Ellinger et al. ..... 250/577

OTHER PUBLICATIONS

Bo-Sung Kang, Kyung Hae Lee, Hyun Ju Park, Young-Kwon Park, Joo-Sik Kim, "Fast pyrolysis of radiate pine in a bench scale plant with fluidised bed: Influence of a char separation system and reaction conditions on the production of bio-oil" J. Anal. Appl. Pyrolysis 76 (2006) 32-37.

M.Predel, W. Kaminsky, "Pyrolysis of mixed polyolefins a fluidised-bed reactor and on a pyroGC/MS to yield aliphatic waxes" Polymer Degradation and Stability 70 (200) 373-385.

* cited by examiner

*Primary Examiner*—Robert J Hill, Jr.
*Assistant Examiner*—Karla Hawkins
(74) *Attorney, Agent, or Firm*—Birch, Stewart, Kolasch & Birch, LLP

(57) ABSTRACT

A carrier gas recycling system is designed according to the procedures in which a carrier gas passes through a reactor, such as a fluidized bed reactor, so as to purify and recycle gas generated in the reaction to substitute for the carrier gas externally applied to the reactor. The carrier gas recycling system includes an oil-water separation chamber to separate and purify carrier gas, and a liquid-sealed constant pressure tank to reduce carrier gas pressure fluctuation and expel extra reaction-generated gas. The carrier gas recycling system also controls the carrier gas flow by controlling the rotating speed of a blower for transferring the carrier gas, and utilizes a heat supply device used in the reaction process to preheat the carrier gas.

7 Claims, 5 Drawing Sheets

CARRIER GAS RECYCLING SYSTEM

FIELD OF THE INVENTION

The present invention relates to a recycling system, and more particularly to a recycling system designed according to the procedures in which a carrier gas passes through a reactor, such as a fluidized bed reactor, so as to recycle gas generated in the reaction.

BACKGROUND OF THE INVENTION

While the highly advanced technologies bring a lot of conveniences to human, they also cause many serious damages to people's living environment. Therefore, it has become a focus among all countries in the world to develop a reasonable way of waste disposal. To comply with the increasingly strict demands for environment protection, different waste decomposition processes are developed. Among others, the so-called fluidized bed reactor has drawn the world's attention.

Please refer to FIG. 1 that is a block diagram of a conventional fluidized bed reactor. As shown, the fluidized bed reactor includes a reactor 10, into which charges 11 are fed. To enhance the mass-energy transfer function of the reactor 10, a carrier gas 12 is applied in the operation of the reactor 10. The carrier gas 12 serves to assist in heat supply, mass transfer, etc., and is sometimes used as part of the reactant in the reaction. The product from the reaction in the reactor 10 is then sent to and condensed and deposited in a condensation tank 20 to generate an oil-water mixture 21 and a mixed gas 22 containing the carrier gas 12.

The conventional fluidized bed reactor shown in FIG. 1 has the following drawbacks in the implementing process thereof:

- The carrier gas is typically nitrogen to maintain the reaction system in an anaerobic state. Since the nitrogen would adversely increase the operation cost, it is uneconomical to expand the reaction system; and
- The carrier gas must be applied from outside of the system, which would dilute the gas generated from the reaction and lessen the purity and utility value of the reaction-generated gas.

It is therefore an important issue to improve the above described conventional fluidized bed reactor.

FIG. 2 is a block diagram showing the implementing process of another conventional fluidized bed reactor, which is developed for use in waste pyrolytic reaction. In this type of fluidized bed reactor, combustible gas generated in the pyrolysis is recycled and used as the fluidizing gas. Therefore, it is not necessary to apply a carrier gas from outside into the reactor 10. The mixture and gas generated in the reactor 10 are condensed and deposited in the condensation tank 20, and the purified reaction-generated gas 23 is recycled and directly guided into the reactor 10 to substitute for the carrier gas.

U.S. Pat. No. 5,728,271 granted to Resource Transformations International Ltd. as well as the research on Hamburg Pyrolysis Plant conducted by Kaminsky et al. in the Hamburg University, Germany are relevant to the waste disposal using the fluidized bed reactor. However, in these two cases, there is only a simple description about the recycling of combustible gas for use as fluidizing gas without details about an operable system therefor. As a matter of fact, to recycle the reaction-generated gas in the fluidized bed, many other factors, such as the maintaining of stable pressure in the system, the expelling of ultra reaction-generated gas, the control of transferred gas, the preheating of gas, etc., must be taken into consideration at the same time.

SUMMARY OF THE INVENTION

A primary object of the present invention is to provide a carrier gas recycling system to realize the recycling of reaction-generated gas for use as a carrier gas in a reaction system.

Another object of the present invention is to provide a carrier gas recycling system that enables elimination of cost for applied carrier gas and upgrades the purity of gas generated in the reaction to largely increase the utility value of the reaction-generated gas.

To achieve the above and other objects, the carrier gas recycling system according to the present invention includes an oil-water separation chamber to separate and purify the carrier gas, and a liquid-sealed constant pressure tank to reduce carrier gas pressure fluctuation and expel extra reaction-generated gas. The system also controls the carrier gas flow by controlling the rotating speed of a blower for transferring the carrier gas, and utilizes a heat supply device used in the reaction process to preheat the carrier gas.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
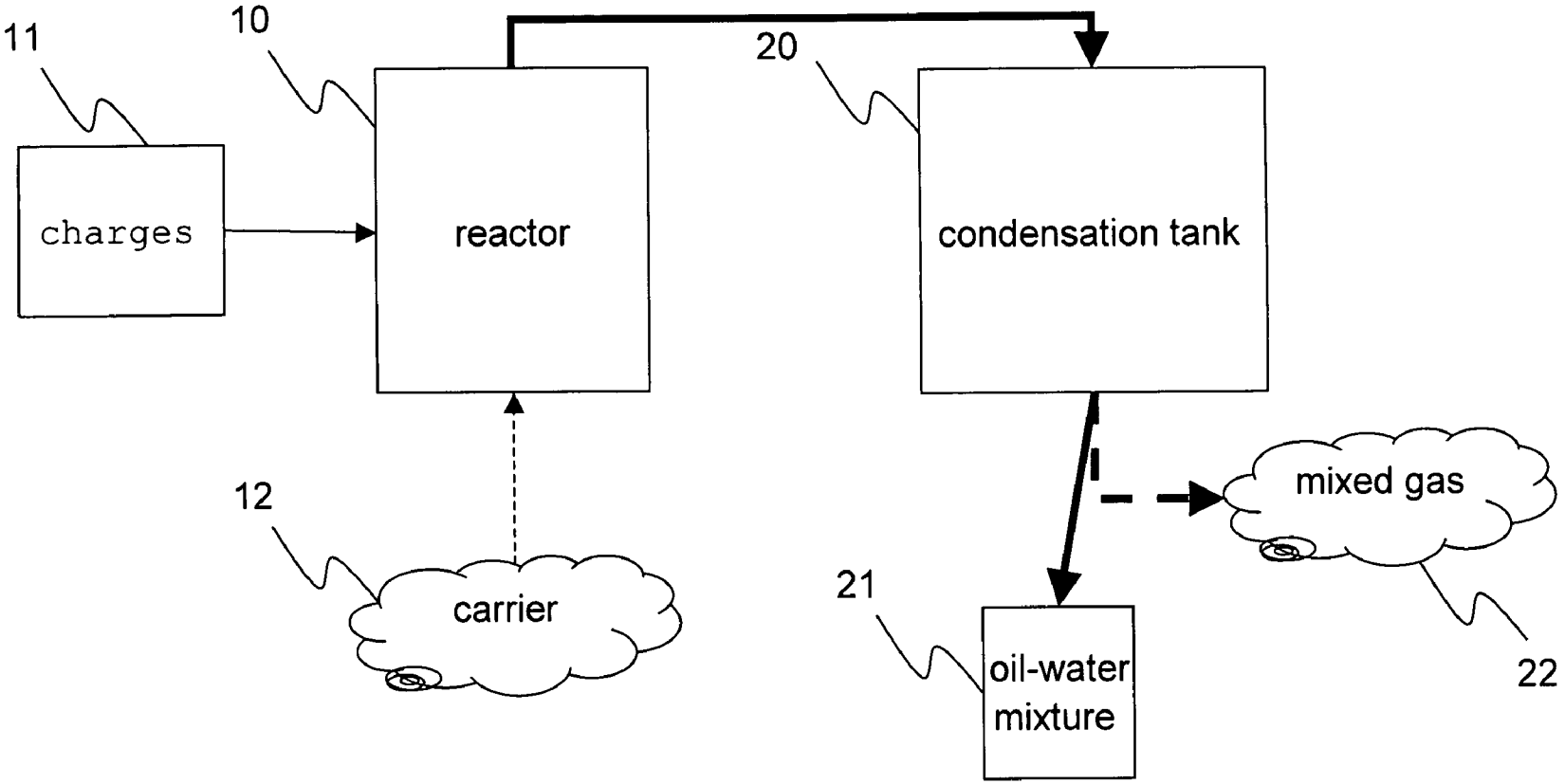
FIG. 1 is a block diagram showing the implementing process of a conventional fluidized bed reactor.
Figure 2:
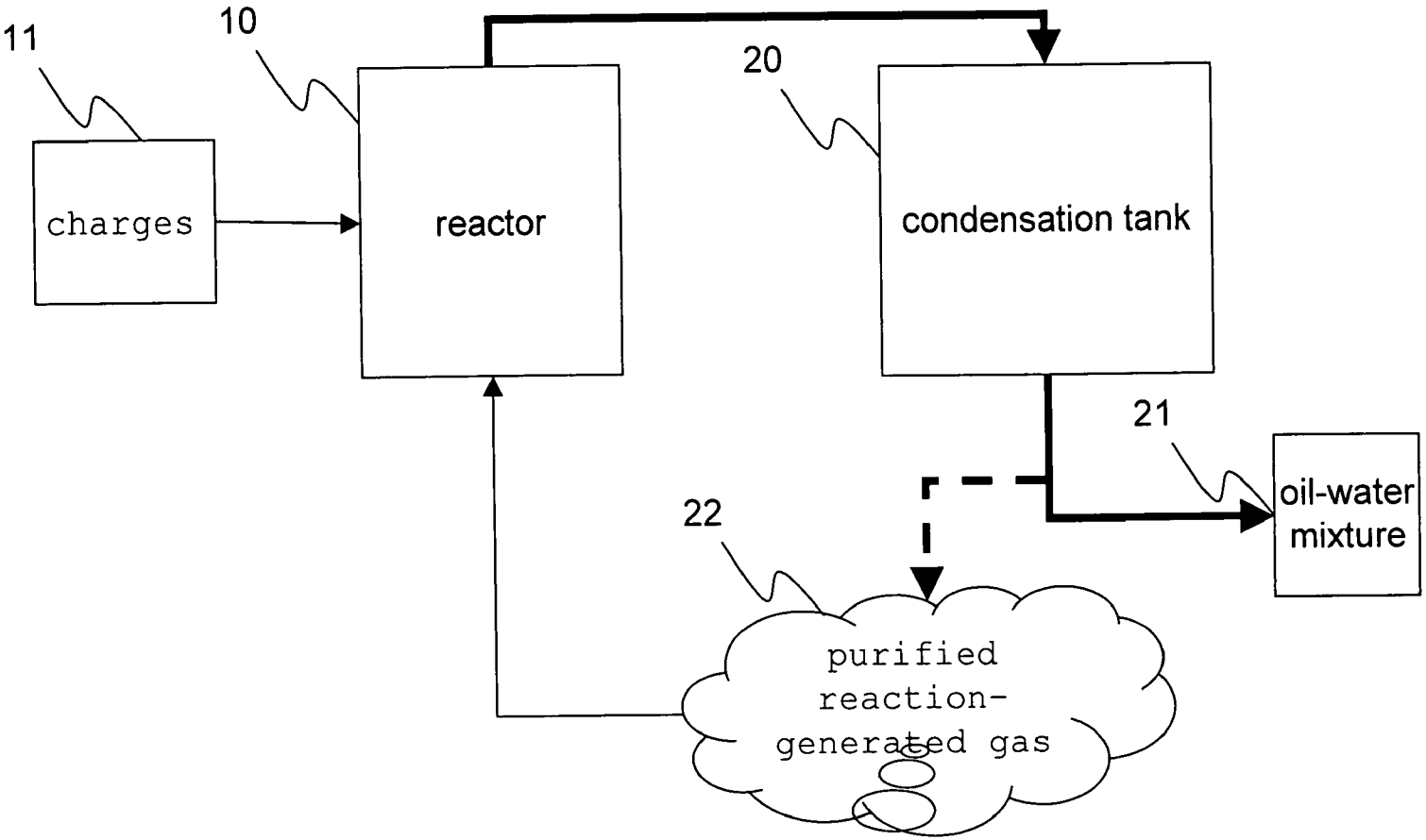
FIG. 2 is a block diagram showing the implementing process of another conventional fluidized bed reactor with gas recycling.
Figure 3:
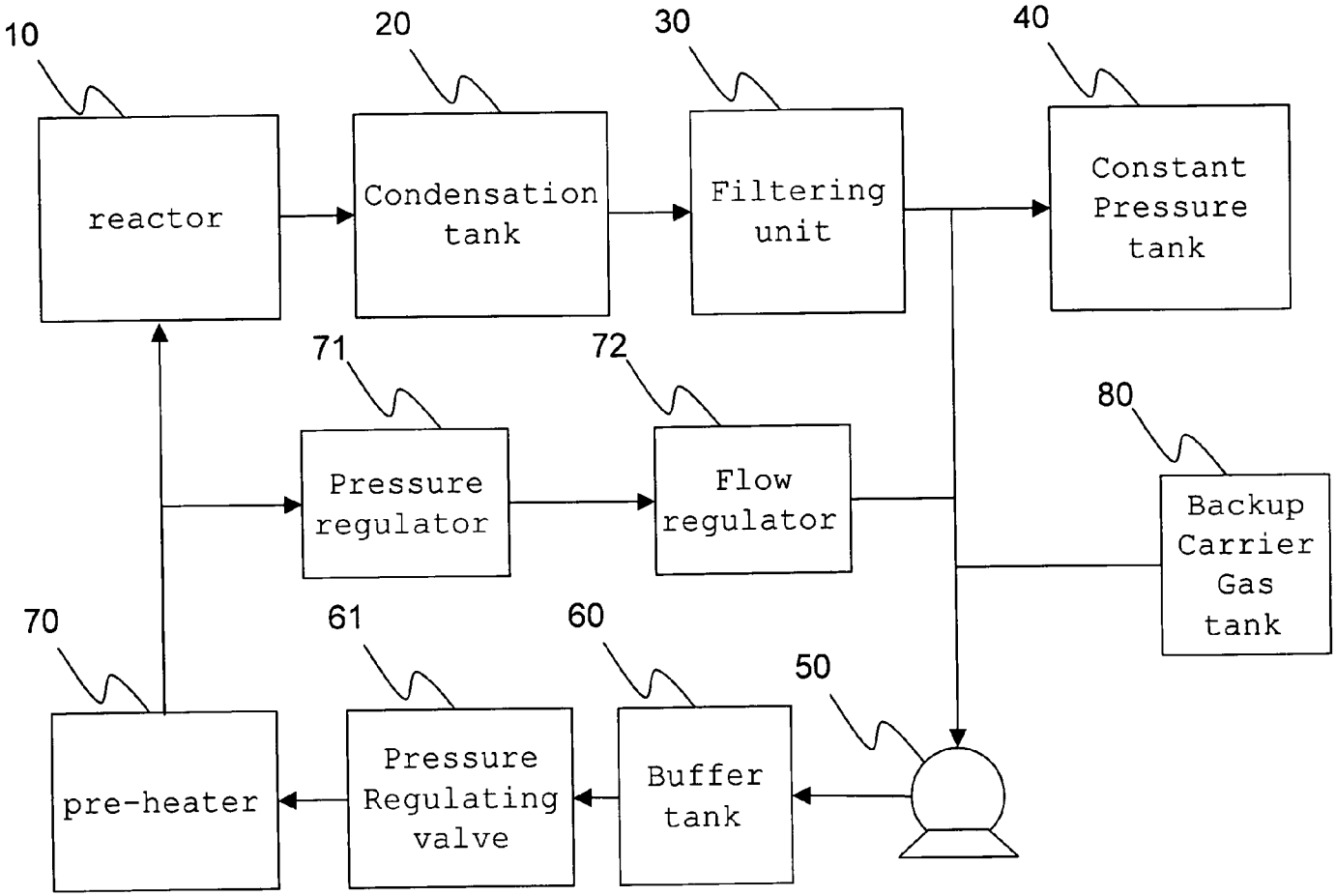
FIG. 3 is a block diagram of a carrier gas recycling system according to the present invention.

Please refer to FIG. 3 that is a block diagram of a carrier gas recycling system according to the present invention designed for mounting in a fluidized bed reaction system, so that part of the gas generated in the reaction is recycled and guided to a reactor thereof to substitute for the carrier gas needed in the operation of the fluidized bed reaction system.

As shown in FIG. 3, the carrier gas recycling system of the present invention includes a reactor 10, a condensation tank 20, a filtering unit 30, a constant pressure tank 40, a transfer device 50, a pre-heater 70, and a backup carrier gas tank 80. The reactor 10 is used to receive and combine charges with a carrier gas to generate a mixture and gas. The condensation tank 20 receives the mixture and gas produced by the reactor 10, separates the oil and water in the mixture from each other, separates and purifies the reaction-generated gas, and delivers the reaction-generated gas to the filtering unit 30. The filtering unit 30 may use a static precipitator to remove particulate pollutant, so as to ensure that the reaction-generated gas is free of any oil-gas deposition and accumulation before being sent into the transfer device 50. The filtered reaction-generated gas is then output via to paths to the constant pressure tank 40 and the transfer device 50 separately.

After receipt of the reaction-generated gas, the constant pressure tank 40 on the one hand maintains a constant pressure in the system balancing with the external atmosphere, and on the other hand outputs the reaction-generated gas for burning (that is, waste gas burning). When the transfer device 50 receives the reaction-generated gas, it recycles and feeds the reaction-generated gas back to the reactor 10, so that a reaction-generated gas circulation loop is formed. The reaction-generated gas is preheated by the pre-heater 70 before being sent into the reactor 10. The preheated reaction-generated gas substitutes for the carrier gas and is cyclically supplied to the reactor 10. The transfer device 50 is also connected to the backup carrier gas tank 80, in which an amount of carrier gas is stored. Before the system has generated any gas, or before the system is actuated, the carrier gas in the backup carrier gas tank 80 is output to maintain system operation.

The transfer device 50 may be a non-explosive or a non-explosion-proof compressor, or a blower for transferring the reaction-generated gas. When the transfer device 50 is a compressor, a buffer tank 60 and a pressure regulating valve 61 must follow the compressor 50, so that the reaction-generated gas from the transfer device 50 is buffered and stored in the buffer tank 60, and regulated by the pressure regulating valve 61 to a predetermined output flow before being fed back for use by the reactor 10. On the other hand, when the transfer device 50 is a blower, the blower may be directly adjusted to a predetermined rotating speed to achieve the purpose of regulating the output flow. The pre-heater 70 preheats the carrier gas in a non-direct contact manner, so that the carrier gas is recycled. When the pre-heater 70 has a preheating temperature that is too high, the temperature is regulated by increasing the gas flow. To maintain a fixed input flow to the reactor 10, any extra gas is properly cooled and recycled back to the transfer device 50. For this purpose, a pressure regulator 71 and a flow regulator 72 are provided following the pre-heater 70. When the transferred carrier gas is increased, the pressure regulator 71 regulates the pressure generated by the carrier gas; and the flow regulator 72 serves to send the extra carrier gas back to the transfer device 50.

Figure 4B:
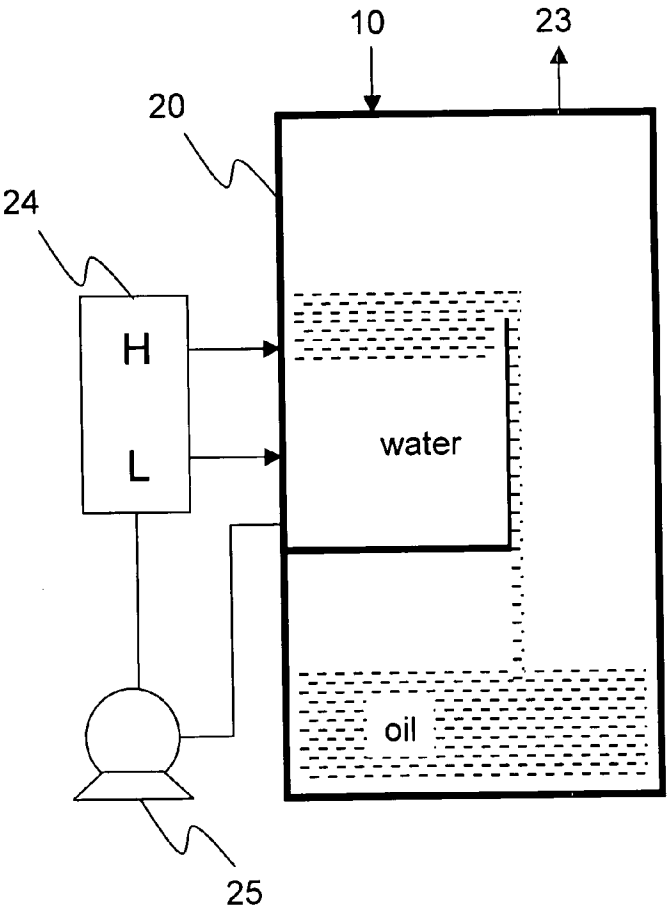
FIGS. 4A and 4B are schematic views of a condensation tank included in the carrier gas recycling system of the present invention.
Figure 4A:
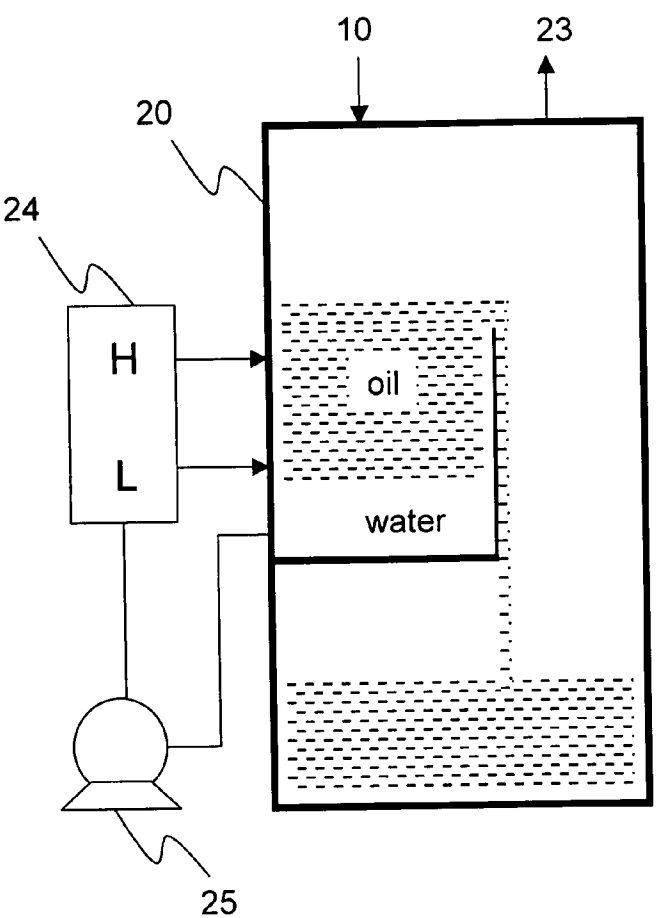

The operation of the condensation tank 20 included in the carrier gas recycling system of the present invention is now described in details with reference to FIGS. 4A and 4B, which are schematic views of the condensation tank 20.

The condensation tank 20 is internally divided into a separation chamber and a storage chamber located below the separation chamber. A photo-sensor 24 and an external pump 25 cooperate with the condensation tank 20 to form a photo-sensing level controlling system. The mixture produced by the reactor 10 and sent to the condensation tank 20 reaches the separation chamber first, at where water and oil in the mixture are separated. Since oil has a specific of gravity lower than water, water in the mixture naturally sink to a lower portion of the separation chamber while oil in the mixture floats on the water surface. When the mixture is continuously sent into the separation chamber, the oil floating on the water would finally flow over the separation chamber into the storage chamber while the water is retained in the separation chamber. The condensation tank 20 is therefore an effective oil-water separating system.

The mixture is continuously sent to the separation chamber during the reaction. At this point, the photo-sensor 24 functions to detect the water level in the separation chamber, so as to prevent the water from flowing over the separation chamber into the storage chamber. When the water level in the separation chamber reaches a high level H preset by the photo-sensor 24, as shown in FIG. 4B, the photo-sensor 24 would send out a start signal to actuate the external pump 25 to pump water out of the separation chamber. To prevent the external pump 25 from pumping the oil from the separation chamber, the photo-sensor 24 would send out a stop signal to the external pump 25 when the water level in the separation chamber reaches a low level L preset by the photo-sensor 24, as shown in FIG. 4A, so that the external pump 25 stop pumping water.

Figure 5B:
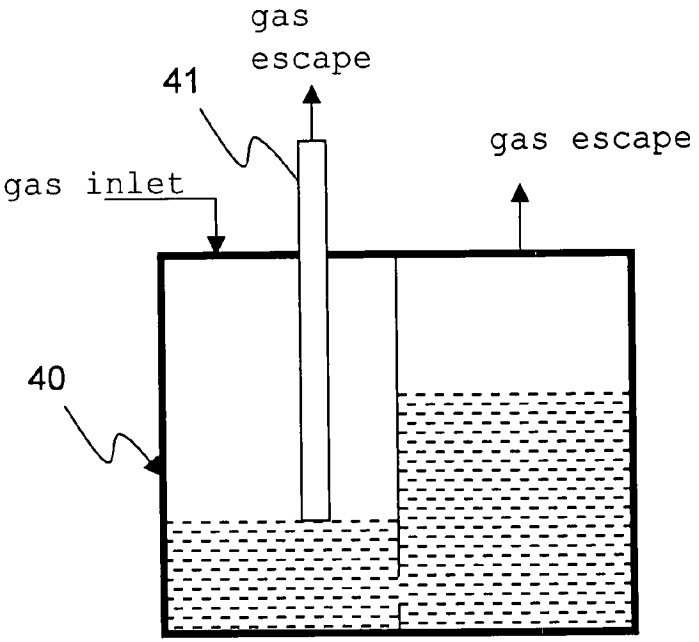
FIGS. 5A and 5B are schematic views of a constant pressure tank included in the carrier gas recycling system of the present invention.
Figure 5A:
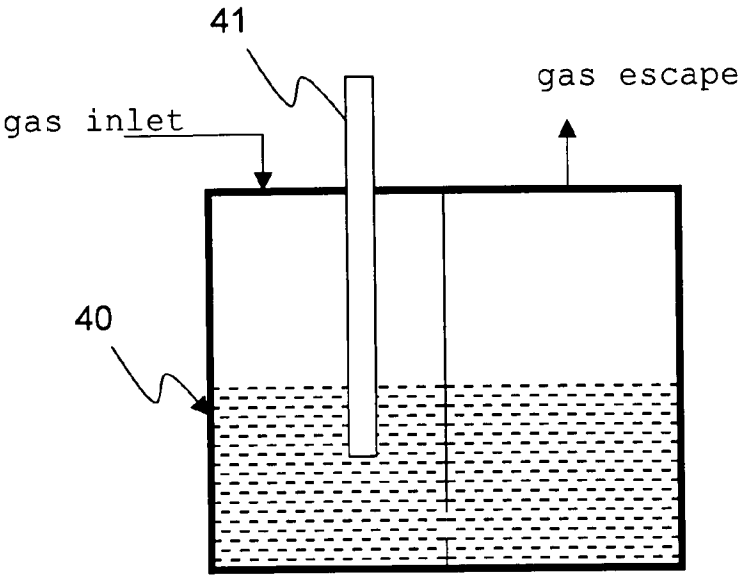

FIGS. 5A and 5B show the operation of the constant pressure tank 40 included in the carrier gas recycling system of the present invention. The constant pressure tank 40 isolates the system from external air by way of liquid seal. In the present invention, a gas escape tube is adopted in the liquid seal to protect the system against exceeded back pressure and high pressure oscillation. As shown in FIGS. 5A and 5B, the constant pressure tank 40 is internally provided with a gas inlet chamber, a gas escape tube 41, and a pressure buffering chamber. The gas inlet chamber and the pressure buffering chamber, which are located at the left and the right side, respectively, of the tank 40 when viewing before the drawing, are separated from each other by a partition wall. However, the constant pressure tank 40 is provided near a bottom of the partition wall with a gas port, via which seal liquid in the tank 40 freely flows between the gas inlet gas chamber and the pressure buffering chamber. The gas escape tube 41 is provided in the gas inlet chamber with a lower end inserted into the seal liquid in the gas inlet chamber. When the reaction-generated gas is sent into the constant pressure tank 40 to accumulate sufficient gas pressure in the tank 40, the seal liquid in the gas inlet chamber is compressed toward the lower end of the gas escape tube 41, and forced into the pressure buffering chamber via the lower gas port, so that the gas inlet chamber is maintained at the constant pressure balanced with the external atmospheric pressure. At this point, the lower end of the gas escape tube 41 inserted in the gas inlet chamber is exposed to the reaction-generated gas due to the lowered liquid level in the gas inlet chamber, and a predetermined quantity of the gas may escape out of the gas inlet chamber via the gas escape tube 41, as shown in FIG. 5B.

The carrier gas recycling system of the present invention is superior to the prior art for the following the features:

(a) Adopting a photo-sensor to control the water level in the oil-water separation chamber of the condensation tank 20;

(b) Adopting seal liquid and gas escape tube in the constant pressure tank 40 to maintain a constant pressure in the system;

(c) Adopting the buffer tank 60 and the pressure regulating valve 61 to control the circulation and transfer of the reaction-generated gas;

(d) Adopting the pressure regulator 71 and the flow regulator 72 to cooperate with the pre-heater 70 in controlling the flow of preheated carrier gas;

(e) Providing the backup carrier gas tank 80; and (f) Being able to purify and accordingly increase the utility value of the reaction-generated gas.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A carrier gas recycling system, which is included in a fluidized bed reaction system to recycle gas generated by the fluidized bed reaction system for use as a carrier gas needed by the reaction system, comprising:

a reactor used to receive charges and combine the received charges with a carrier gas of the fluidized bed reaction system to generate a mixture and gas;

a condensation tank used to receive the mixture and gas generated by said reactor, separate oil and water in the mixture from each other, and separate and purify the reaction-generated gas;

a filtering unit connected to said condensation tank for filtering the reaction-generated gas and outputting the filtered gas via two paths at the same time;

a constant pressure tank for receiving the filtered reaction-generated gas output from said filtering unit via one of the two paths, outputting the received gas for burning, and maintaining the system at a constant pressure balancing with the external atmospheric pressure;

a transfer device for receiving the filtered reaction-generated gas output from said filtering unit via the other one of the two paths, and transferring the received gas back to said reactor, so as to form a circulation loop for the reaction-generated gas;

a pre-heater for preheating the reaction-generated gas output from said transfer device before the gas is fed into said reactor; and a backup carrier gas tank connected to said transfer device and having an amount of the carrier gas stored therein, the carrier gas in said backup carrier gas tank being output to said transfer device to start and maintain the reaction system operation when the system has not yet generated gas.

2. The carrier gas recycling system as claimed in claim 1, wherein said condensation tank further includes:

a separation chamber for receiving the mixture generated by said reactor, such that water in the received mixture is stored in said separation chamber while oil in the received mixture is allowed to flow over a top of said separation chamber;

a storage chamber located below said separation chamber for storing oil flown over said separation chamber;

a photo-sensor having a high level and a low level preset therein, and capable of detecting a water level in said separation chamber; said photo-sensor sending out a start signal when the water level in said separation chamber reaches the preset high level, and sending out a stop signal when the water level in said separation chamber lowers to the preset low level; and an external pump connected to said separation chamber for pumping water out of said separation chamber when a start signal is received from said photo-sensor, and said external pump stopping pumping water when a stop signal is received from said photo-sensor.

3. The carrier gas recycling system as claimed in claim 1, wherein said constant pressure tank further includes:

a gas inlet chamber having a predetermined amount of seal liquid stored therein for buffering a gas pressure produced by the input reaction-generated gas in said constant pressure tank;

a gas escape tube provided at said gas inlet chamber with a lower end inserted into said seal liquid, such that when said seal liquid is compressed by the input reaction-generated gas to have a level lower than the lower end of said gas escape tube, the input reaction-generated gas may escape from said gas inlet chamber via the lower end of said gas escape tube; and a pressure buffering chamber communicable with said gas inlet chamber via a gas port provided at a predetermined position on a partition wall between said pressure buffering chamber and said gas inlet chamber, such that said seal liquid being compressed by said input reaction-generated gas in said gas inlet chamber is able to flow into said pressure buffering chamber via said gas port to balancing the gas pressure in said gas inlet chamber.

4. The carrier gas recycling system as claimed in claim 1, wherein said transfer device is selected from the group consisting of a compressor and a blower.

5. The carrier gas recycling system as claimed in claim 4, wherein said transfer device is a compressor, and said carrier gas recycling system further comprising a buffer tank and a pressure regulating valve following said compressor; said buffer tank being connected to said compressor for buffering and storing the reaction-generated gas output from said transfer device; and said pressure regulating valve being connected to said buffer tank for controlling an output flow of the reaction-generated gas from said transfer device.

6. The carrier gas recycling system as claimed in claim 1, wherein said pre-heater preheats the carrier gas in a non-direct contact manner, and is able to increase the carrier gas flow being transferred to thereby regulate a preheating temperature thereof when said preheating temperature becomes too high; and wherein said pre-heater is followed by a pressure regulator and a flow regulator to maintain a fixed gas flow input to said reactor; said pressure regulator being capable of regulating a gas pressure generated by an increased carrier gas flow; and said flow regulator being capable of circulating any extra carrier gas back to said transfer device.

7. The carrier gas recycling system as claimed in claim 1, wherein said backup carrier gas tank enables the reaction system to be in an anaerobic environment before the system starts generating gas.

* * * * *